United States Patent [19]

Rahbe et al.

[11] Patent Number: 4,655,903

[45] Date of Patent: Apr. 7, 1987

[54] RECYCLE OF UNCONVERTED HYDROCRACKED RESIDUAL TO HYDROCRACKER AFTER REMOVAL OF UNSTABLE POLYNUCLEAR HYDROCARBONS

[75] Inventors: Georgette Rahbe, Los Teques, Edo Miranda; Roger Marzin, San Antonia de los Altos; Ivan Cavicchioli, Caracas; Julio Krasuk, Los Teques, all of Venezuela

[73] Assignee: Intevep, S.A., Caracas, Venezuela

[21] Appl. No.: 735,694

[22] Filed: May 20, 1985

[51] Int. Cl.[4] ..... C10G 37/00

[52] U.S. Cl. ..... 208/96; 208/58

[58] Field of Search ..... 208/48 R, 58, 83, 96, 208/59

[56] References Cited

U.S. PATENT DOCUMENTS

| | | | |
|---|---|---|---|
| 3,514,395 | 5/1970 | McVay et al. | 208/96 |
| 3,790,470 | 2/1974 | Mead et al. | 208/96 |
| 3,923,636 | 12/1975 | Mead et al. | 208/58 |
| 3,929,617 | 12/1975 | Henry et al. | 208/96 |
| 4,062,758 | 12/1977 | Goudriaan et al. | 208/58 X |
| 4,191,636 | 3/1980 | Fukui et al. | 208/96 X |
| 4,364,819 | 12/1982 | Hutchings et al. | 208/96 |

*Primary Examiner*—Glenn Caldarola

*Attorney, Agent, or Firm*—Bachman & LaPointe

[57] ABSTRACT

Hydrocracking and separating process for upgrading unconverted residuals so as to increase liquid yields while at the same time decrease fouling of the hydrocracking reactor upon recycling of the upgraded residual to the hydrocracker. The unconverted residual from the hydrocracking unit is treated in a separation stage with a light hydrocarbon solvent so as to remove the polynuclear hydrocarbons from the residual prior to recycling.

13 Claims, 2 Drawing Figures

RECYCLE OF UNCONVERTED HYDROCRACKED RESIDUAL TO HYDROCRACKER AFTER REMOVAL OF UNSTABLE POLYNUCLEAR HYDROCARBONS

BACKGROUND OF THE INVENTION

The present invention is drawn to a hydrocracking process for upgrading unconverted residuals and, more particularly, a process for upgrading unconverted residuals by the removal of degraded unstable polynuclear hydrocarbons thereby allowing the upgraded residual to be recycled to the hydrocracker so as to increase liquid yields while at the same time decrease fouling of the hydrocracker.

Polynuclear hydrocarbons are known to be coke precursors in hydrocracking reactions. By polynuclear hydrocarbons is meant xylene soluble hydrocarbon materials which are in effect coke precursors. The precursor effect is especially critical when the bottoms of the hydrocracked product are recycled back to the hydrocracking reactor. The bottoms, which are high in polynuclear hydrocarbons, are very refractory when subjected to further cracking. Polynuclear hydrocarbons tend to build up in the reaction zone resulting in fouling problems inside the reactor as well as the preheaters. Another disadvantageous effect resulting from recycling the bottoms having high contents of polynuclear hydrocarbons is the increase in coke deposits on the catalyst used in cracking which negatively effects the activity of the catalyst.

Naturally, it is highly desirable to provide a process for upgrading unconverted hydrocracked bottom products by removing therefrom the unstable polynuclear hydrocarbons which foul the hydrocracker reactor when the bottoms are recirculated thereto. It is particularly useful for increasing liquid yields, maintaining catalyst activity and decreasing reactor fouling.

Accordingly, it is a principal object of the present invention to provide a process for upgrading unconverted residuals.

It is a particular object of the present invention to provide a process for upgrading unconverted residuals by removing therefrom unstable polynuclear hydrocarbons.

It is a further object of the present invention to provide a process wherein the upgraded unconverted residuals are readily recycled to a hydrocracking reactor so as to increase liquid yields.

It is a still further object of the present invention to provide a process for increasing liquid yields when recycling unconverted residuals without excessive fouling of the heater tubes and hydrocracking reactor.

Further objects and advantages of the present invention will appear hereinbelow.

SUMMARY OF THE INVENTION

In accordance with the present invention the foregoing objects and advantages are readily obtained.

The present invention relates to a hydrocracking and separating process for upgrading unconverted residuals so as to increase liquid yields while at the same time decrease fouling of the hydrocracking reactor upon recycling of the upgraded residual to the hydrocracker. In accordance with the present invention unconverted residuals from a hydrocracking unit are treated in a separation stage so as to remove polynuclear hydrocarbons from the residual prior to recycling the residual to a hydrocracking reactor. The treatment in the separator involves mixing the unconverted residual with a light hydrocarbon solvent so as to reduce the viscosity of the mixture and thereby increase the incompatibility of the polynuclear hydrocarbons with the mixture. By incompatibility is meant that the polynuclear hydrocarbons of heavier molecular weight are not well dispersed or are immiscible within the hydroconverted product because of their high degree of aromaticity and condensation as can be measured by well known techniques such as NMR (Nuclear Magnetic Resonance). Polynuclear hydrocarbons are characterized by an aromaticity defined as the ratio of aromatic carbons to total carbons of greater than 0.6 as measured by NMR techniques and a hydrogen to carbon atomic ratio of less than 1.1. The condensation as defined by the ratio of aromatic bridged carbon to total aromatic carbons is in the range of 0.35 to 0.6 as measured by NMR techniques. The added solvent possibly enhances said incompatibility therefor, allowing efficient separation of the polynuclear hydrocarbons in a solid/liquid separation stage.

In accordance with the present invention, after separation of the polynuclear hydrocarbons from the unconverted residual the clean residual is recycled to the hydrocracking reactor so as to increase liquid yield while at the same time eliminate any fouling of the heater tubes and of the reactor which would result if the polynuclear hydrocarbons were present in the recycle.

DETAILED DESCRIPTION

The present invention is drawn to a hydrocracking process for increasing liquid yields and decreasing fouling in the hydrocracking reactor by the removal of polynuclear hydrocarbons from unconverted residuals and recycling the upgraded, polynuclear hydrocarbon free residual to the hydrocracking unit.

Figure 1:
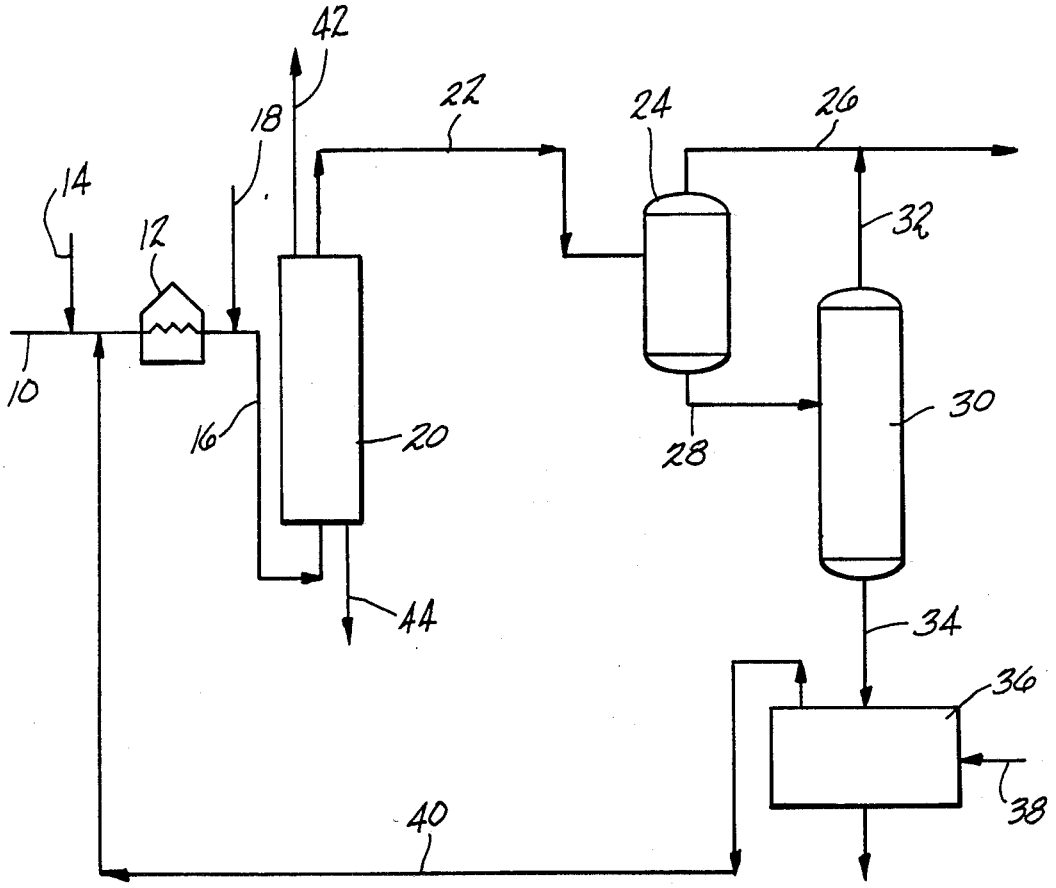
FIG. 1 is a schematic diagram illustrating one flow scheme of the process of the present invention.

With reference to FIG. 1, a heavy crude or any fractional residual from the crude is fed via line 10 to a preheater 12. A finely divided catalyst is mixed with the incoming crude in line 10 via line 4 prior to delivery to the preheater 12. The catalyst employed in the process of the present invention may be any typical hydrocracking catalyst such as Co-Mo on alumina, red mud, iron mineral ores, iron on coal or coke, and the like. Suitable particle size of the catalyst is from about between 0.1 μm to 1000 μm and preferably from about between 0.5 μm to 100 μm. The concentration of catalyst in the crude feed should be in the range of about between 0.1 to 6.0 wt.% with respect to the feed.

The preheat stream is removed from preheater 12 via line 16 and is mixed with hot hydrogen from line 18 prior to delivery to the hydrocracking reactor 20. The ratio of hydrogen to crude feed is about between 3000 to 30,000 SCF/B. The reactor 20 may be in the form of a bubble column type reactor, upflow slurry reactor, ebullated bed reactor or a cascade of such reactors. It should be understood that, in the case where an ebullated bed reactor is used, no catalyst is added through line 14 to the heavy crude of line 10. In this case, the catalyst is contained inside the ebullated bed reactor in fluidized state and it is periodically renewed by addition of fresh catalyst through line 42 and removal of used catalyst through line 44. This is no limitation on the range of operating conditions in the hydrocracking reactor; however, the preferred conditions are pressure about between 500 to 4800 psi, LHSV of about between 0.1 to 2 $HR^{-1}$, hydrogen-crude ratio of about between 3,000 to 30,000 SCF/B and temperature of about between 770° to 900° F. The LHSV is defined as the ratio of the volumetric feed rate of fresh feed to the volume of the reactor.

After reaction in the hydrocracker 20, the effluents are removed via line 22 and fed to a hot separator 24 which operates at approximately the same pressure and temperature as the hydrocracker 20 so as to obtain a light hydrocarbon stream 26 and a residual hydrocracked product 28. The residual hydrocracked product may be fed directly to the separation stage or, in the preferred embodiment, is fed via line 28 to a vacuum distillaton or vacuum flash unit 30 which operates at the following conditions: pressure in the range 5–50 mm Hg and temperature between 550° to 700° F. so as to obtain a vacuum distillate recovered via line 32 and mixed with the light hydrocarbon stream 26 to form a synthetic crude which is free of any vacuum residual. The vacuum residual is then fed via line 34 to the separation stage 36 where the residual is mixed with a light hydrocarbon solvent from line 38 and, wherein, in accordance with the present invention, the degraded unstable polynuclear hydrocarbons are separated out from the residual. The upgraded, polynuclear hydrocarbon free residual is then recycled via line 40 where it is mixed with virgin feed in line 10 prior to delivery to preheater 12.

The separation stage 36 is the critical step in the process of the present invention. By mixing a light hydrocarbon solvent with the unconverted residual the viscosity of the residual is reduced thereby facilitating the separation of polynuclear hydrocarbons. The amount of the polynuclear hydrocarbon removed in the separation stage is dependent on the degree of incompatibility between the polynuclear hydrocarbons and the light hydrocarbon solvent which is mixed with the uncovered residual. By incompatibility again is meant that the hydroconverted product is unable to dissolve or disperse well the highly aromatic and condensed molecules, of large molecular weight, produced during the hydrocracking reactions. The degree of condensation is measured by NMR (Nuclear Magnetic Resonance) as well as the aromaticity which is the ratio of the number of aromatic carbons to total carbons. The high temperatures used in the hydrocracking reactor (approximately 450° C.) give rise to an intense free radical formation, which tend to polymerize. These high molecular polynuclear hydrocarbons tend to segragate from the hydroconverted product, this precipitation or incompatibility depending on many factors such as aromatic content and degree of condensation, aromatic content of the hydroconverted product and of the added diluent or solvent, temperature, solvent to hydroconverted residue ratio, etc. It has been found that an increase in incompatibility and correspondingly an increase in polynuclear hydrocarbon separation is obtained when going from kerosene (12%wt. aromatics) having boiling range of 190°–330° C. to naphthas having boiling point ranges in the order of 50° C. to 190° C. to mixtures of pure components such as butanes, pentanes, hexanes, heptanes, and octanes. The other parameter which controls the separation efficiency of polynuclear hydrocarbons is the ratio of solvent to unconverted residual; this ratio should be in the range of about 0.5/1 to 10/1, preferably between about 1/1 to 6/1 by volume.

This is no limitation as to the type of separation equipment which can be used in the separation stage of the present invention; however, the preferred equipment is a centrifugal decanter.

The process of the present invention offers the following advantages. By removing the polynuclear hydrocarbons from the unconverted residual, fouling of the liquid preheater is considerably reduced. In addition, and more importantly, by eliminating the accumulation of the polynuclear hydrocarbons, which are coke precursors, in the hydrocracking reactor, catalyst activity is enhanced and fouling of the reactor and preheater tubes is reduced. Furthermore, by allowing for recycling of the upgraded residual, higher liquid yields are obtained thereby adding to the economics of the process.

These and other advantages of the present invention will be made clear from the following examples.

EXAMPLE I

A vacuum residual of heavy Venezuelan crude oil, namely Zuata crude, having an API gravity of 3 was subjected to a hydrocracking process in an upflow slurry reactor under the following conditions: pressure=1900 psig; temperature=844° F.; $H_2$/oil ratio=10,000 SCF/B; LHSV=0.37 $HR^{-1}$; percent catalyst=3 wt.%; catalyst=limonite; conversion 950° F.+ residual=93 wt.%. The effluents were fed to a hot separator where the unconverted residual was separated out. In order to demonstrate the effect of the light hydrocarbon solvent on the separation of the polynuclear hydrocarbons, a portion of the unconverted residual was mixed with kerosene in a ratio of 1/1 by volume and then subjected to centrifugal separation. A portion of the unconverted residual which was not mixed with the solvent was also subject to centrifugal separation. The resultant liquids were then analyzed to show the influence of the solvent. The results are set forth in Table I.

TABLE I

| | Case 1 Unconverted 950° F.+ Residual Without Solvent Addition | Case 2 Unconverted 950° F.+ Residual With Solvent Addition |
|---|---|---|
| °API gravity | −3 | +2 |
| Sulfur (wt. %) | 2.3 | 2.0 |
| Conradson Carbon (wt. %) | 35 | 26 |
| Asphaltene (wt. %) | 30 | 21 |
| Spot Test (ASTM D2781) | 4 | 1 |
| Yield of Removed Polynuclear Hycrocarbons | | |
| wt. % of unconverted residual | — | 11.5 |
| wt. % of fresh feed to hydrocracking reactor | — | 1.0 |

As can be seen from the foregoing a significant improvement in the quality of the unconverted residual is obtained when a solvent is employed in the separation stage. For example, the results show a significant improvement in the API gravity and Conradson carbon levels with a removal of 11.5 wt.% of degraded materials. In addition, the spot test indicates an improved upgraded residual substantially free of polynuclear hydrocarbons.

EXAMPLE II

A 390° F. resid of heavy Venezuelan crude oil, namely Cerro Negro crude, was subjected to a hydrocracking process in an ebullated bed type reactor under the following conditions: pressure=2000 psig; temperature=788° F.; $H_2$/oil ratio=8000 SCF/B; LHSV=0.53 $HR^{-1}$; catalyst=300 cc of Bauxite impregnated with Mo as 1/16 inch extrudates; conversion 950° F.+residual=55%. The effluents were thereafter treated in the same manner described above for Example I. The results are set forth in Table II.

TABLE II

| | Case 1 Unconverted 950° F.+ Residual Without Solvent Addition | Case 2 Unconverted 950° F.+ Residual With Solvent Addition |
|---|---|---|
| °API gravity | 0.1 | 3.0 |
| Sulfur (wt. %) | 3.4 | 3.0 |
| Conradson Carbon (wt. %) | 31.6 | 25.3 |
| Asphaltene (wt. %) | 22.3 | 18.2 |
| Spot Test (ASTM D2781) | 3 | 1 |
| Yield of Removed Polynuclear Hycrocarbons | | |
| wt. % of unconverted residual | — | 6.0 |
| wt. % of fresh feed to hydrocracking reactor | — | 1.5 |

Again, a significant improvement in the quality of the unconverted residual is obtained when a solvent is employed in the spearation stage.

EXAMPLE III

In order to demonstrate the effect of polynuclear hydrocarbons on the fouling rate in the preheater, the laboratory test procedure described in ASTM 1661 was modified in order to calculate the fouling rate of heat transfer surfaces. The fouling rate is a measure of the decrease in heat transfer co-efficient resulting from deposits on the walls of the electrical heater's outer surface and therefore gives an indication of the magnitude of the fouling rate in commercial preheaters. Four cases were considered. Case 1 corresponds to feeding a virgin vacuum resid to the preheater 12 of FIG. 1. Case 2 is a recycle scheme of the unconverted vacuum resid back to the preheater 12 where no solvent is mixed with the unconverted vacuum resid in the separation stage (case 2 of Example I). Cases 3 and 4 are recycle schemes where light hydrocarbon solvents were mixed with the unconverted vacuum resid in the separation stage. In case 3 the solvent used was naphtha in a solvent/oil ratio of 1/1 and in case 4 the solvent used was kerosene in a solvent/oil ratio of 1/1. Table III shows the results of the test indicating the positive influence of polynuclear hydrocarbon removal on the fouling rate. In case 3 where naphtha was the solvent used in the separation stage the fouling rate is quite similar to that of virgin feedstock, that is, case 1. While there is some removal of polynuclear hydrocarbons in case 2 where no solvent is used in the separation stage, it is clear from cases 3 and 4 that the solvent greatly aids in removing the polynuclear hydrocarbons and correspondingly has an improved effect on the fouling rate.

TABLE III

COMPARISON OF FOULING RATES FOR DIFFERENT DEGREE OF POLYNUCLEAR HYDROCARBONS REMOVAL

| Case No. | 1 | 2 | 3 | 4 |
|---|---|---|---|---|
| Operation Mode | Once Through | Recycle | Recycle | Recycle |
| Nature of Stream 4 (Ref. FIGS. 1 & 2) | Virgin VR | (Virgin VR) (Recycled VR) | (Virgin VR) (Recycled VR) | (Virgin VR) (Recycled VR) |
| Recycle Ratio (Virgin VR)/ (Recycled VR) | — | (100/21 w/w) | (100/21 w/w) | (100/21 w/w) |
| Overall Vacuum Resid Conversion (% wt.) | 90.5 | 97.0 | 93.0 | 93.5 |
| Solvent Used in Separation Stage | — | None | Naphtha | Kerosene |
| Boiling Range (°F.) | — | — | 122–238 | 282–550 |
| % w Paraffins | — | — | 95.5 | 84 |
| Solvent/Oil Ratio (v/v) | — | — | 1/1 | 1/1 |
| Removal of Polynuclear Hydrocarbons (% w on Fresh VR Fed to Hycrocracking Stage) | — | 2.1 | 5.9 | 3.9 |
| Fouling Rate* ($Ft^2 \cdot Hr \cdot °F./BTU \cdot HR$) | $9 \cdot 10^{-5}$ | $81 \cdot 10^{-5}$ | $12 \cdot 10^{-5}$ | $33 \cdot 10^{-5}$ |

*Calculation Method:
HEAT TRANSFER COEFFICIENT $h_{(t)} = Q/A(T_w - T_f)$ where $T_w$ and $T_f$ are the test probe and fluid temperatures respectively, Q the heat input and A the heat transfer area.
FOULING FACTOR $R_f = 1/h_{(t)} - 1/h_{(o)}$ where $h_{(t)}$ and $h_{(o)}$ are the heat transfer coefficients at time t and at time t = o
FOULING RATE FR = $dR_f/d_t$
The fouling rate was evaluated at $t_w$ = 660° F.

EXAMPLE IV

Figure 2:
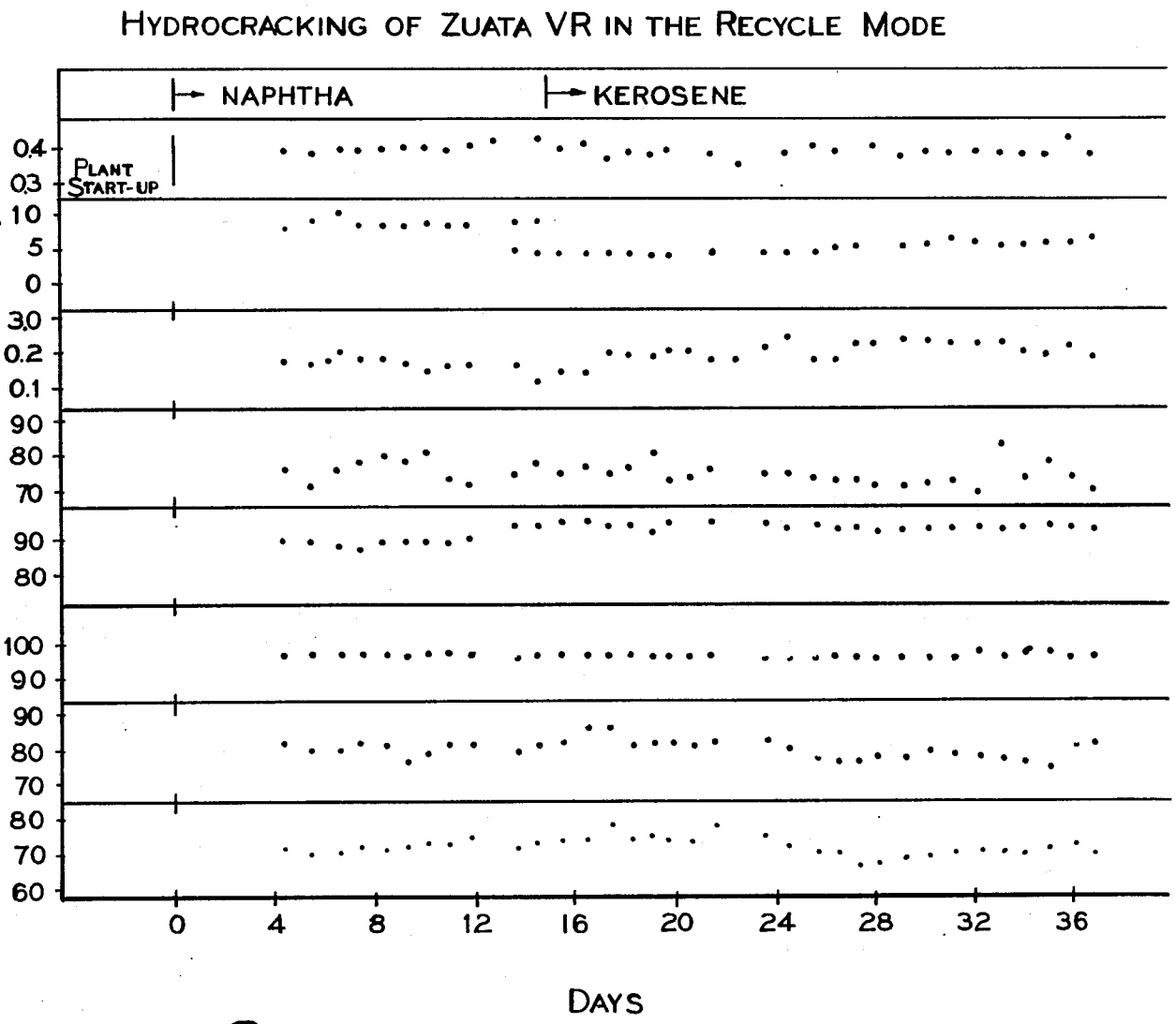
FIG. 2 is a graph illustrating the effect of the process of the present invention on the removal of polynuclear hydrocarbons and fouling of the reactor unit.

A vacuum reside of heavy Venezuelan crude oil, namely Zuata crude, having an API gravity of 3 was subjected to the hydrocracking and recycling process illustrated in FIG. 1 under the following conditions: reactor=slurry reactor; pressure=1900 psig; temperature=844° F.; $H_2$/oil ratio=10,500 SCF/B; LHSV=0.37 $HR^{-1}$; percent catalyst in fresh feed=3.0 wt.%; and the catalyst was red mud. The experimental results are shown in FIG. 2. Two different solvents were used in the separation stage. In the first part of the experiment a naphtha cut having a boiling point range of 122° to 238° F. was used and in the second part a heavier solvent, namely, kerosene, having a boiling range of 282° to 550° F. was used. It can be seen from FIG. 2 that the removal of the polynuclear hydrocarbon coke precursors is higher in the case of the naphtha solvent than for the kerosene solvent. As a result, a higher total conversion level is obtained in the case of kerosene. The other important result that can be seen from FIG. 2 is the stability of the conversion levels obtained throughout the run. This stability of the conversion levels clearly demonstrates that there is no accumulation of refractory degraded polynuclear hydrocarbons in the reaction system indicating the positive effect of the removal of the polynuclear hydrocarbons on the fouling of the preheater and hydrocracking unit.

EXAMPLE V

In order to demonstrate the effect on liquid yields of the recycling scheme illustrated in FIG. 1, the Zuata crude of Example I was fed through the hydrocracker, hot separator and distillation unit under the hydrocracking process conditions set forth in Example I. Case 1 of Table IV illustrates the yields obtained in a once through separating mode where no recycle of the upgraded unconverted residual takes place. Case 2 shows a recycle scheme wherein a solvent of kerosene of the type described with regard to Example I is mixed with the unconverted residual in the separation stage.

TABLE IV

COMPARISON OF YIELDS UNDER RECYCLE AND ONCE THROUGH OPERATION MODES

| Case No. | 1 | 2 |
|---|---|---|
| Operating Mode | Once Through | Recycle |
| Operating Pressure (psig) | 1900 | 1900 |
| Solvent Used in Separation Stage | — | Kerosene |
| LHSV on Fresh VR Feed (v/v HR) | 0.37 | 0.37 |
| Overall 950° F.+ Conversion (wt. %) | 90.0 | 93.2 |
| Recycle Ratio (Fresh VR Feed/Recycle) (w/w) | — | 100/25 |
| $C_5$ - 950° F. Liquid Yield | | |
| (W %) | 76.3 | 81.4 |
| (V %) | 90.4 | 96.4 |
| Gas ($C_1$–$C_4$) Yield on Fresh VR Feed (% w) | 12.7 | 11.0 |
| Hydrogen Consumption (SCF/B) on Fresh VR Feed | 2100 | 1700 |
| Coke Yield on Fresh VR Feed (% w) | 2.3 | 1.7 |
| Polynuclear Hydrocarbon Removal on Fresh VR Feed (% w) | — | 3.9 |
| Estimated Vaporization in Hydrocracking Reactor (wt. %) | 90 | 70 |

The main difference between case 1 and 2 is the conversion level per pass which is in the order of 90% in case 1 while in the recycle scheme of case 2 it is in the order of 60 to 80%. It is known that in the hydrocracking of heavy crude oil the $C_1$–$C_4$ yield increases very sharply above 80% conversion per pass with an associated increase in the hydrogen consumption and a pronounced decrease in liquid yield. Thus, as can be seen from Table IV the recycle mode of case 2 is very favorable with respect to case 1. If the recycled hydrocracked vacuum resid contains polynuclear hydrocarbons then upon further hydrocracking there would be an increase in gas and coke yields, the magnitude of which would have an overall negative effect on the process. Table IV clearly demonstrates that, when using kerosene in the separation stage, the removal of degraded polynuclear hydrocarbons is high and selective enough to produce a recycle stream which can be further hydrocracked without increased gas and coke yields. The recycle scheme produces a higher $C_5$-950° F. liquid yield with a lower hydrogen which enhances the profitability of the process. Vapor liquid equilibrium calculations show that the degree of vaporization in case 1 is relatively high when compared with case 2. The degree of vaporization in the reactor indicates the pasty nature of the slurry and correspondingly the polynuclear hydrocarbon content. In light of the lower vaporization in case 2 fouling in the reactor would not be expected and therefore one would expect a more stable operation in the scheme of case 2.

As can be seen from the foregoing examples the process of the present invention offers numerous advantages over processes heretofore known. By removing the polynuclear hydrocarbons from the unconverted residual, fouling of the liquid preheater is considerably reduced. In addition, by eliminating the accumulation of the polynuclear hydrocarbons, which are coke precursors in the hydrocarbon reactor, catalyst activity is enhanced and fouling of the reactor and preheater are reduced. Furthermore by allowing for recycle of the upgraded residual, higher liquid yields are obtained thereby adding to the profitability of the process.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which comes within the meaning and range of equivalency are intended to be embraced therein.

What is claimed is:

1. A process for upgrading unconverted residuals by the removal of degraded unstable polynuclear hydrocarbons and recycling said uprgraded residual to the hydrocracker so as to increase liquid yields while at the same time decrease fouling of the hydrocracker and preheater upstream of said hydrocracker comprising feeding a heavy crude feedstock to a hydrocracking reactor; hydrocracking said heavy crude feedstock in said reactor under the following conditions: pressure about between 500 to 4000 psi, LHSV of about between 0.1 to 2 $HR^{-1}$, hydrogen-crude ratio of about between 3,000 to 30,000 SCF/B and temperature of about between 770° to 900° F. wherein an effluent overhead is produced; feeding said effluent to a hot separator; treating said effluent in said hot separator wherein a light hydrocarbon stream and a slurry hydrocracked product residual are produced; feeding said slurry hydrocracked product residual to a separator; mixing a solvent selected from the group consisting of kerosenes, naphthas, butanes, pentanes, hexanes, heptanes, octanes and mixtures thereof with said hydrocracked residual in a ratio of from about 0.5/1 to 10/1 by volume in said separator so as to reduce the viscosity of said hydrocracked residual and thereby increase the incompatibility of the polynuclear hydrocarbons in said hydrocracked residual allowing for efficient separation of the polynuclear hydrocarbons; separating out the polynuclear hydrocarbons from said hydrocracked residual so as to produce an upgraded hydrocracked solvent rich residual substantially free of said polynuclear hydrocarbons; and recycling only said upgraded hydrocracked solvent rich residual substantially free of said polynuclear hydrocarbons to a preheater and thereafter to said hydrocracking reactor for further treatment.

2. A process according to claim 1 wherein said hydrocracking reactor is a slurry type reactor.

3. A process according to claim 2 including mixing a catalyst with said heavy crude feedstock prior to feeding said heavy crude feedstock to the slurry type hydrocracking reactor.

4. A process according to claim 3 including feeding hydrogen to the heavy crude feedstock-catalyst mixture prior to feeding the mixture of crude feedstock, hydrogen and catalyst to said slurry type hydrocracking reactor.

5. A process according to claim 1 wherein said hydrocracking reactor is an ebullated type reactor.

6. A process according to claim 5 including feeding hydrogen to the heavy crude feedstock prior to feeding the heavy crude feedstock to said ebullated type reactor.

7. A process according to claim 6 including feeding hot hydrogen to said ebullated type reactor containing a hydrocracking catalyst in the fluidized state.

8. A process according to claim 5 including feeding hot hydrogen to said ebullated type reactor containing a hydrocracking catalyst in the fluidized state.

9. A process according to claim 1 including feeding said slurry hydrocracked product residual to a vacuum unit wherein vacuum distillates and a vacuum bottom is produced and thereafter feeding said vacuum bottom to said separator.

10. A process according to claim 1 wherein said solvent is mixed with said hydrocracked residual in a ratio of from about 1/1 to 6/1 by volume.

11. A process according to claim 4 including feeding said slurry hydrocracked product residual to a vacuum unit wherein vacuum distillates and a vacuum bottom is produced and thereafter feeding said vacuum bottom to said separator.

12. A process according to claim 7 including feeding said slurry hydrocracked product residual to a vacuum unit wherein vacuum distillates and a vacuum bottom is produced and thereafter feeding said vacuum bottom to said separator.

13. A process according to claim 6 including feeding said slurry hydrocracked product residual to a vacuum unit wherein vacuum distillates and a vacuum bottom is produced and thereafter feeding said vacuum bottom to said separator.

* * * * *